US012065918B2

(12) United States Patent
Pickett

(10) Patent No.: US 12,065,918 B2
(45) Date of Patent: Aug. 20, 2024

(54) SYSTEMS AND METHODS FOR STEAM FRACKING

(71) Applicant: Joshua R&D Technologies, llc, Plano, TX (US)

(72) Inventor: David Pickett, Plano, TX (US)

(73) Assignee: Joshua R&DTechnologies, LLC, Plano, TX (US)

( * ) Notice: Subject to any disclaimer, the term of this patent is extended or adjusted under 35 U.S.C. 154(b) by 0 days.

(21) Appl. No.: 17/828,220

(22) Filed: May 31, 2022

(65) Prior Publication Data

US 2022/0381123 A1 Dec. 1, 2022

Related U.S. Application Data

(60) Provisional application No. 63/195,146, filed on May 31, 2021.

(51) Int. Cl.
*E21B 43/263* (2006.01)
*E21B 43/24* (2006.01)

(52) U.S. Cl.
CPC ..... *E21B 43/263* (2013.01); *E21B 43/2401* (2013.01); *E21B 43/2405* (2013.01)

(58) Field of Classification Search
CPC . E21B 43/263; E21B 43/2401; E21B 43/2405
See application file for complete search history.

(56) References Cited

U.S. PATENT DOCUMENTS

2016/0003600 A1* 1/2016 Glenn ..... F42C 19/08 102/202.5
2017/0067300 A1* 3/2017 Andrigo ..... E21B 17/1028
2019/0271220 A1* 9/2019 Magnotti ..... E21B 43/26

* cited by examiner

*Primary Examiner* — Caroline N Butcher
*Assistant Examiner* — Nicholas D Wlodarski
(74) *Attorney, Agent, or Firm* — Kirby Drake

(57) ABSTRACT

Systems and methods for steam fracking may provide for fracking at a lower cost, providing faster cycles, higher pressure, and more perforation, thereby making a safer system and less expensive method. A high-energy spark initiator may be maneuvered into a horizontal drill hole where a petroleum-bearing formation is fractured for trapped petroleum to flow out through cracks and into the horizontal borehole and pumped to the surface for collection. The horizontal borehole may be flooded with slickwater which may submerge the spark initiator. A high-energy electric charge may be sparked across the contacts on the spark initiator, followed by a high energy steam explosion caused by the heat of the spark. This may heat the water in the borehole near the initiator into high-pressure live steam which forces slickwater into the formation's cracks, opening the cracks wider where the slickwater sand will pack into cracks to hold them open.

10 Claims, 1 Drawing Sheet

SYSTEMS AND METHODS FOR STEAM FRACKING

CROSS-REFERENCE TO RELATED APPLICATION

The present application is a non-provisional of, and claims priority to, U.S. Patent Application No. 63/195,146 filed May 31, 2021, the disclosure of which is incorporated by reference in its entirety.

FIELD OF THE DISCLOSURE

The present disclosure generally relates to hydraulic fracturing, and more particularly to hydraulic fracturing through steam pressure.

BACKGROUND

Fracking is shorthand for hydraulic fracturing, a type of petroleum well completion that has been used commercially for 65 years. Today, the combination of advanced mechanical pump hydraulic fracturing and horizontal drilling, employing cutting-edge technologies, is mostly responsible for surging U.S. oil and natural gas production. Currently, hydraulic water pump fracking is expensive, making payback lengthy, and making smaller well production not cost effective. High pressure hydraulic water pump fracking is dangerous, adding to operating costs of insurance. The hydraulic water pump process must be repeated numerous times with lengthy delays for mechanical pumps to build up the hydraulic pressure needed to fracture oil or gas bearing formations or 'frack'.

SUMMARY

Embodiments of the present disclosure may provide systems and methods for high pressure steam fracking. These systems and methods may provide for fracking at a lower cost, providing faster cycles, higher pressure, and more perforation, thereby making a safer system and less expensive fracking method. A device like a spark plug servers as a high-energy spark initiator may be maneuvered into a horizontal drill hole where a petroleum-bearing formation needs to be fractured to release the petroleum trapped in the formation to flow out through cracks in the formation and into the horizontal borehole, where the oil/gas is pumped/flows up hole to the surface for collection. The horizontal borehole may be flooded with "fracking water" (water and sand) (slickwater) or water which may submerge the spark initiator. A high-energy electric charge may be sent to the spark initiator in the range of approximately 100,000 to 1 million joules. The voltage may be sparked across the positive and negative contacts on the spark initiator (like a spark plug), which creates a high-pressure steam explosion caused by the heat of the initiator spark. This may heat the water in the borehole near the initiator into very high-pressure live steam.

Embodiments of the present disclosure may provide a method for steam fracking comprising: maneuvering one or more high-energy spark initiators into a horizontal borehole; flooding the horizontal borehole with fracking water, wherein the high-energy spark initiator may be submerged; and sending a high-energy electric charge to the spark initiator which may result in a high-pressure steam explosion that may create high pressure live steam in the water in the horizontal borehole near the spark initiator. More than one high-energy spark initiator may be maneuvered into the horizontal borehole. More than one high-energy spark initiator may be wired in series or in parallel. The high-energy electric charge may be sent in a range of approximately 100,000 to 1 million joules.

Other embodiments of the present disclosure may provide a steam explosion fracking spark initiator comprising: a plurality of carbon fiber springs that contact a formation as an electrical ground; a positive electrode; a negative electrode; and a leader wire running up a drillhole to a set of capacitors connecting the electrodes to initiate a spark, wherein the positive and negative electrodes are provided in an open space to be flooded with water. The positive and negative electrodes may be formed of carbon or carbon/ceramic or other suitable high temperature conductive material. The positive electrode may have a non-conductive ceramic insulator housing and the negative electronic may have a conductive housing. The conductive housing may receive the plurality of carbon fiber springs to create an electrical connection and ground from a formation to the negative electrode. The spark initiator also may include at least one negative polarity wire from a capacitor bank connected to the earth as a ground and another wire downhole to provide additional grounding by connection to the negative electrode or by connection to the formation. The spark initiator may utilize one or more direct current (DC) generators to charge a capacitor bank to store energy needed for a steam explosion spark. A total power charge of the capacitor bank sent to the spark initiator may be adjusted to control a depth of hydraulic formation fracking. A switch may be used to pass a charge from the capacitor bank to the spark initiator in a horizontal bore hole to initiate a steam explosion to cause hydraulic formation fracking.

Further embodiments of the present disclosure may provide a steam fracking spark initiator system comprising: a long tubing section closed at both ends; a carbon and/or ceramic spark initiator inserted into the long tubing section; and slickwater filling the spark initiator, wherein the spark initiator may receive an electrical charge from a capacitor bank and a steam explosion occurs and data may be collected to control the system's function in a well horizontal bore hole.

BRIEF DESCRIPTION OF THE DRAWINGS

For a more complete understanding of this disclosure, reference is now made to the following description, taken in conjunction with the accompanying drawing, in which:

The FIGS. 1A and 1B depict a steam fracking spark initiator according to an embodiment of the present disclosure.

DETAILED DESCRIPTION

Embodiments of the present disclosure may provide systems and methods for high pressure steam fracking. These systems and methods may provide for fracking at a lower cost, providing faster cycles, higher pressure, and more perforation, thereby making a safer system and method.

A high-energy spark initiator may be maneuvered into a horizontal drill hole where a petroleum-bearing formation needs to be fractured for the petroleum trapped in the formation to flow out through cracks in the formation and into the horizontal borehole, where it is pumped/flows up hole to the surface for collection. It should be appreciated that there may be more than one spark initiator in the horizontal borehole, whether wired in series or in parallel.

The horizontal borehole may be flooded with "fracking water" (water and sand) (slickwater) or water which may submerge the spark initiator(s). A high-energy electric charge may be sent to the spark initiator in the range of approximately 100,000 to 1 million joules. The voltage may be sparked across the positive and negative contacts on the spark initiator (like a spark plug), followed by a high energy steam explosion caused by the heat of the initiator spark. This may heat the water in the borehole near the initiator into very high-pressure live steam.

Figure 1A:
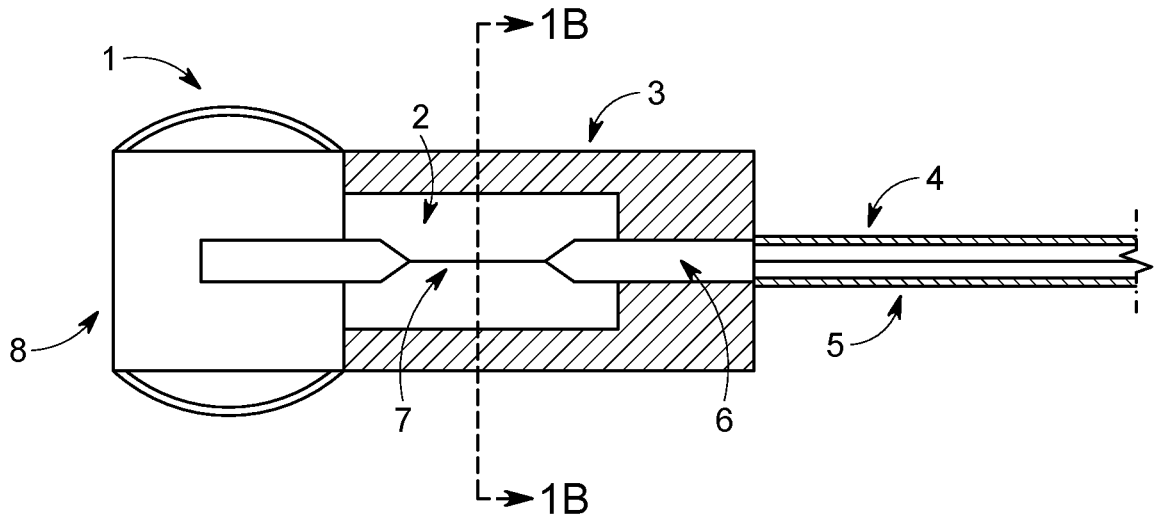
Figure 1B:
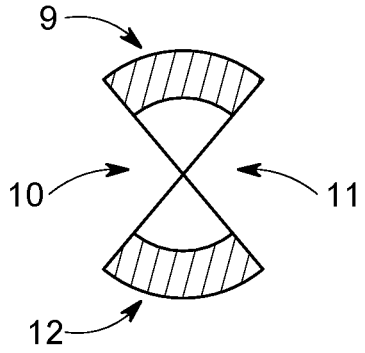

FIG. 1A depicts a steam fracking spark initiator according to an embodiment of the present disclosure. As depicted herein, the steam fracking spark initiator may include carbon fiber or other suitable material contact "springs" 1 on the outside of the spark initiator to contact the inner surface to the horizontal bore hole or the bore hole tubing as an electrical ground. The drill pipe may be connected to the electrical circuit ground at the surface. There may be a carbon spark initiator housing 8 for earth grounding. If earth grounding is insufficient, two wires for positive and negative electrical current downhole may be used in embodiments of the present disclosure. The steam fracking spark initiator may include a leader wire 7 across the positive and negative electrodes to initiate a spark. Electrodes may be provided in an open space 2 to flood with water. A carbon or carbon/ceramic, or other suitable material electrode, (similar to the operation of an arc lamp) 6, may be provided along with a flexible woven, non-conductive ceramic insulator 3 sheath 4 and within the insulator, a carbon fiber or other material conductive wire 5 to the uphole discharge capacitors. Cross section "A" 12 in FIG. 1B reflects the positioning of non-conductive ceramic insulators 9 with a steam explosion expansion opening 11 which may be open for flooding with slickwater 10. Salt may be added to the horizontal bore hole water to increase the water's conductivity to create a conductive pathway between the electrodes for the spark.

The live steam may expand approximately 1,700 times the weight/volume of the water. The water near the spark may be converted to steam at up to approximately 17,000 pounds per square inch (PSI) almost instantaneously. This steam pressure may be approximately twice the pressure in a shotgun barrel and much higher pressure than seen with traditional fracking (9,000 PSI). This sharp steam explosion gas bubble may instantaneously expand and push against the remaining horizontal column of liquid water/sand in the borehole that was not converted to steam. This large force against the horizontal column of incompressible water may exert a very high instantaneous hydraulic force pressure against the formations along the horizontal borehole. The very high-pressure impulse pressure from the steam explosion may create a hydraulic pressure along the entire column of water in the horizontal borehole containing the water/sand.

Since water is not compressible, the entire instantaneous 17,000 PSI hydraulic impulse may be transmitted evenly along the horizontal column of water, where the extreme hydraulic impulse force may cause fractures in the formation to "spread open," and the water/sand may be forced to jet into the fractures and be compacted into the formation cracks at the high-pressure impulse to "hold the cracks open" so the petroleum or gas that the formation contains will flow out later. This high-pressure hydraulic impulse pressure on the walls of the entire length of the horizontal borehole may crack the rock formation to a depth and extent proportional to the hydraulic pressure caused by the steam explosion's energy.

From the standard hydraulic pressure fracking method, there is a relationship between the amount of hydraulic pressure and the extent of the formation cracking. An "instantaneous" hydraulic impulse may tend to cause more and deeper cracking in the formation walls instead of slowly "opening" or "spreading" existing cracks with the slow buildup of truck pump hydraulic pressure fracking. The depth and extent of instantaneous pressure impulse may greatly exceed the slow buildup of a traditional surface hydraulic pump.

The body of the spark initiator (see FIG. 1A) which supports the up hole carbon fiber positive charge wire according to embodiments of the present disclosure may be made from high-temperature insulating ceramic or other suitable non-conductive materials. The portion of the body of the spark initiator that is grounded to the horizontal bore hole is made from a high temperature conductive material such as carbon or carbon fiber or conductive ceramics or other suitable material. The wire extending up the bore hole from the spark initiator electrode to the power source according to embodiments of the present disclosure may be made of carbon fiber with a woven non-conductive ceramic insulation sheath or other suitable high temperature materials. The electrodes are made of carbon or conductive ceramic or other conductive high temperature tolerant material (similar to an arc lamp). This composition may address the issue of the extreme heat of the spark at the electrodes of spark initiator melting the metal of the electrodes as well as a very high current in the wire running from the spark initiator's electrodes to the surface energy source melting the wire.

Embodiments of the present disclosure may utilize one or more commercially available direct current (DC) generators to charge up a capacitor bank to store enough energy needed for the steam explosion spark(s). A capacitor bank may be charged up by generators of any size, not requiring large generators.

It should be appreciated that capacitors according to embodiments of the present disclosure may be standard capacitors available in the electric power transmission and generator industry. Capacitors according to embodiments of the present disclosure also may be new "super capacitors" which may be more expensive than standard capacitors but can offer advantages in size and discharge rate.

In embodiments of the present disclosure, the large switches that may be needed to connect the capacitors to the wire going downhole to the spark initiator may be standard switches available in the electric power transmission and generator industry. The switches according to embodiments of the present disclosure may be fitted with carbon or carbon ceramic or suitable material contactors to prevent melting with discharge.

The high-pressure steam explosion impulse may create hydraulic water pressure up the vertical borehole to the well as far as the water (mud) column continues to carry the hydraulic pressure. Such extreme instantaneous impulse hydraulic pressure to the well head would have devastating damage to the wellhead, rig and personnel. By having no water (mud) column for some distance above the vertical borehole fluid level in embodiments of the present disclosure, there will be no hydraulic pressure extended up the borehole. The column of air from the vertical drill pipe/bore hole liquid level up to the well head acts like a shock absorber between the vertical hydraulic column of drilling mud and the surface. The downhole hydraulic pressure impulse may meet the up-hole air column, and the hydraulic pressured surge may be absorbed by the compressible air column. The pressurized air may merely be a controlled bleed off. To capture/recycle the energy, the pressured bleed air can turn a generator to charge the capacitors. Alternatively, a valve may be fitted in the horizontal drill hole or up hole tubing liquid area to hold back the steam pressure from the up hole well head.

In the present disclosure, the horizontal tubing may have a plurality of large holes to let the live steam explosion pressure move from inside the tubing to the formation to reduce the drop in pressure while the steam is passing from the tubing to the formation.

The methods according to embodiments of the present disclosure may be repeated with measured steam explosions as fast as the generators can cycle/charge up the capacitors. The repetition may occur numerous times in quick succession because the electrodes and spark initiator as well as the downhole electrical conductive wire and the switch contacts are not melted or damaged with each discharge. Electricity from transmission lines or motor generators and transformers may be used instead of/or to supplement commercial portable generators.

The extent/depth of the hydraulic formation fracking may be controlled by adjusting the total power charge of the capacitor bank that is sent to the spark initiator which may control the heat from the spark and the resulting steam explosion pressures. For example, the energy from 1,000 horsepower (HP) pumps for 10 minutes could have been stored in capacitors and released as an instantaneous (1/1000th of a second) spark resulting in 36 billion impulse horsepower of hydraulic fracking pressure for the steam explosion. Energy generated over 10 minutes by a 1,000 HP generator in embodiments of the present disclosure can instead be stored and discharged in about 1/1000 of a second, greatly compounding the hydraulic pressure on the formation by a factor of 3,600,000, less the energy lost as heat and resistance, loss in steam propagation, loss over the length of the (carbon fiber conductor ceramic fabric insulated) wire, and losses to the earth ground between the spark initiator and the capacitor switch.

Systems and methods for steam fracking according to embodiments of the present disclosure do not require special high-pressure pumps. The systems and methods for steam fracking may use commercially available portable DC generators in embodiments of the present disclosure. Embodiments of the present disclosure may use commercially available power transmission equipment (i.e., capacitors and switches). Carbon-ceramic spark initiators according to embodiments of the present disclosure may be easily fabricated in a machine shop, and carbon fiber wire is generally available.

Various safety benefits may be achieved using systems and methods according to embodiments of the present disclosure. No dangerous high-pressure pumps are used. No dangerous high-pressure pipes, tubing, or hoses are used. There may be no unpredictable high pressure running down the expensive well borehole which hydraulic fracking may cause collapse or other damage. There also may not be any dangerous high-pressure buildup running down the expensive well borehole which may cause collapse or other damage, destroying the hole.

Using systems and methods according to embodiments of the present disclosure, cost per completed steam fracking project may be less expensive and faster than pump systems. No expensive special high pressure well tubing is needed. Standard slickwater fracking chemicals may be used. Inexpensive generators may use less fuel than expensive high pressure hydraulic pump trucks.

Using systems and methods according to embodiments of the present disclosure may enable fracking of formations that are now not possible to frack due to limitations in mechanical pump pressure. Greatly reduced fracking costs using systems and methods according to embodiments of the present disclosure may make it possible to frack lesser wells where the payback with pump trucks was previously not feasible or payback too long or insufficient budgets. There also may be more economic feasibility for opening non-producing wells. Further, it may be easier to make fracking legal in places where it has not been in the past due to issues such as water pollution. There are no noisy high-pressure pumps running for hours; just relatively quiet generators (no generators needed where local electric lines are nearby).

A system according to embodiments of the present disclosure may be formed by assembling a long tubing section, closed at both ends, inserting a small-scale carbon and ceramic spark initiator, and filling with slickwater. A large measured instantaneous electrical charge may be sent from a capacitor bank to the spark initiator. The hydraulic pressure from the steam explosion may be measured against the electric power used. These pressures may be extrapolated to known mechanical pump fracking pressure tables and compared to the fuel used and cycle time between fracks, to establish cost savings. An extrapolation of the cost savings of not using high pressure mechanical pumps, tubing or valves, the labor associated with these, and the cost of money thereof may be made. An extrapolation of the total project timeline period of steam fracking versus mechanical pump fracking may be made. An extrapolation of the total project timeline cost of steam explosion fracking versus mechanical pump fracking also may be made.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method for steam fracking comprising:

maneuvering one or more high-energy spark initiators into a horizontal borehole, the one or more high-energy spark initiators comprising:

a plurality of carbon fiber springs that contact a formation as an electrical ground;

a positive electrode having a non-conductive ceramic insulator housing;

a negative electrode having a conductive housing that receives the plurality of carbon fiber springs on an exterior of the conductive housing; and a leader wire running up a drillhole to a set of capacitors connecting the electrodes to initiate a spark, wherein the positive and negative electrodes are provided in an open space to be flooded with water;

flooding the horizontal borehole with fracking water, wherein the one or more high-energy spark initiators are submerged; and sending a high-energy electric charge to the spark initiator which results in a high-pressure steam explosion that creates high pressure live steam in the water in the horizontal borehole near the one or more high-energy spark initiators.

2. The method of claim 1, wherein the high-energy spark initiators are maneuvered into the horizontal borehole.

3. The method of claim 2, wherein the high-energy spark initiators are wired in series or in parallel.

4. The method of claim 1, wherein the high-energy electric charge is sent in a range of approximately 100,000 to 1 million joules.

5. A steam explosion fracking spark initiator comprising:

a plurality of carbon fiber springs that contact a formation as an electrical ground;

a positive electrode having a non-conductive ceramic insulator housing;

a negative electrode having a conductive housing that receives the plurality of carbon fiber springs on an exterior of the conductive housing; and a leader wire running up a drillhole to a set of capacitors connecting the electrodes to initiate a spark, wherein the positive and negative electrodes are provided in an open space to be flooded with water.

6. The spark initiator of claim 5, wherein the positive and negative electrodes are formed of carbon or carbon/ceramic or other suitable high temperature conductive material.

7. The spark initiator of claim 5 further comprising:

at least one negative polarity wire from a capacitor bank as a ground and another wire downhole to provide additional grounding by connection to the negative electrode or by connection to the formation.

8. The spark initiator of claim 5, wherein the spark initiator utilizes one or more direct current (DC) generators to charge a capacitor bank to store energy needed for a steam explosion spark.

9. The spark initiator of claim 8, wherein a total power charge of the capacitor bank sent to the spark initiator is adjusted to control a depth of hydraulic formation fracking.

10. The spark initiator of claim 8, wherein a switch is used to pass a charge from the capacitor bank to the spark initiator in a horizontal bore hole to initiate a steam explosion to cause hydraulic formation fracking.

* * * * *